US009231288B2

(12) United States Patent
Morgenstern et al.

(10) Patent No.: US 9,231,288 B2
(45) Date of Patent: Jan. 5, 2016

(54) HIGH FREQUENCY SIGNAL COMBINER

(75) Inventors: Michael Morgenstern, Schoeneiche (DE); Reimo Dueben, Schoeneiche (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 269 days.

(21) Appl. No.: 13/822,896

(22) PCT Filed: Aug. 17, 2011

(86) PCT No.: PCT/EP2011/064122

§ 371 (c)(1),
(2), (4) Date: Mar. 13, 2013

(87) PCT Pub. No.: WO2012/034804

PCT Pub. Date: Mar. 22, 2012

(65) Prior Publication Data

US 2013/0169377 A1 Jul. 4, 2013

(30) Foreign Application Priority Data

Sep. 17, 2010 (DE) ..... 10 2010 045 779

(51) Int. Cl.
*H03H 7/38* (2006.01)
*H01P 5/12* (2006.01)

(52) U.S. Cl.
CPC ..... *H01P 5/12* (2013.01)

(58) Field of Classification Search
CPC ..... H01P 5/12; H03H 7/46; H03H 7/461; H03H 7/48; H03H 7/482
USPC ..... 333/124, 126, 129
See application file for complete search history.

(56) References Cited

U.S. PATENT DOCUMENTS 4,774,481 A * 9/1988 Edwards et al. ..... 333/127
6,300,848 B1 10/2001 Miyaji et al.

(Continued)

FOREIGN PATENT DOCUMENTS

GB 2 279 504 A 1/1995

OTHER PUBLICATIONS

International Preliminary Report on Patentability issued in corresponding application No. PCT/EP2011/064122 dated Jan. 15, 2013.

(Continued)

*Primary Examiner* — Robert Pascal
*Assistant Examiner* — Kimberly Glenn
(74) *Attorney, Agent, or Firm* — Carter, DeLuca, Farrell & Schmidt, LLP

(57) ABSTRACT

A high-frequency signal combiner comprises at least one first bridge coupler for the transformation of two input-end, first high-frequency signals into at least two output-end, first high-frequency signals in each case with identical power, and a second bridge coupler for the transformation of four input-end, second high-frequency signals, in each case with identical power, into an output-end, second high-frequency signal, of which the power corresponds to the summated power of the four input-end, second high-frequency signals. In this context, the four input-end, second high-frequency signals are each supplied from one output-end, first high-frequency signal. In order to add an integer multiple of four high-frequency signals, a cascade of second bridge couplers is realized with a number of cascade stages corresponding to the integer multiple. In every cascade stage, every second bridge coupler of the preceding cascade stage is replaced respectively by four second bridge couplers.

13 Claims, 9 Drawing Sheets

(56) References Cited

U.S. PATENT DOCUMENTS

Figure 1A:
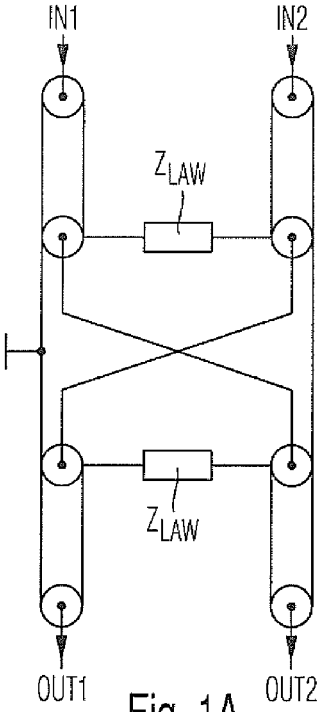

| | | | | |
|---|---|---|---|---|
| 6,407,648 | B1 | 6/2002 | Johnson | |
| 6,472,950 | B1 | 10/2002 | London | |
| 7,345,557 | B2 | 3/2008 | Podell | |
| 2014/0203889 | A1 * | 7/2014 | Lewis et al. | 333/136 |

OTHER PUBLICATIONS

International Search Report issued in corresponding application No. PCT/EP2011/064122 mailed Dec. 20, 2011.

* cited by examiner (State of the art)

HIGH FREQUENCY SIGNAL COMBINER

The invention relates to a high-frequency signal combiner.

Currently available high-frequency signal combiners, for example, Wilkinson, Geysel or 3 dB couplers, can typically be used only over a few octaves and therefore do not provide an adequate bandwidth. In the case of hybrid couplers and ring hybrids used at low frequencies, an impedance transformation at the level of 2:1 occurs additionally in every coupling stage, which necessitates an additional high-ohmic and therefore high-loss transformer.

A bridge coupler, which partially overcomes these disadvantages and provides the following properties, is known from U.S. Pat. No. 6,407,648 B1:

no impedance transformation required, low losses because of short line lengths, low phase distortions between the individual inputs and the output because of the short line lengths and decoupled inputs.

However, the bridge coupler from U.S. Pat. No. 6,407,648 B1 is disadvantageously limited to coupling a total of only four high-frequency signals.

The object of the invention is therefore to develop a broadband, low-loss, high-frequency signal combiner, which can combine a plurality of high-frequency signals.

The object of the invention is achieved by a high-frequency signal combiner according to the invention with the features of claim 1. Advantageous further developments are specified in the respective dependent claims.

According to the invention, a cascading of the high-frequency signal combiner takes place.

The high-frequency signal combiner according to the prior art, which comprises a connection of two first bridge couplers realised respectively as decoupling bridges and a second bridge coupler realised as a coupling bridge, is advantageously cascaded by replacing, in each cascade, every second bridge coupler of the preceding cascade stage with respectively four second bridge couplers of a subsequent cascade stage.

In this manner, the number of high-frequency signals to be combined can be quadrupled in every cascade stage. In total, this therefore combines a number of high-frequency signals four times greater than the number of cascade stages.

The substitution of a second bridge coupler of the preceding cascade stage with four second bridge couplers of the subsequent cascade stage is preferably implemented in that each bridge branch of the second bridge coupler of the preceding cascade stage forms a bridge diagonal of a second bridge coupler of the subsequent cascade stage. A load balancing resistor with an impedance corresponding to the system impedance of the high-frequency signal combiner is connected in the respectively other bridge diagonal transversely to the direction of the signal energy of the second bridge coupler of the subsequent cascade stage generated in this manner.

The input-end high-frequency signals fed into the bridge branches of the second bridge coupler which is realised as a coupling bridge must provide at least approximately identical powers because of the coupler principle. Accordingly, first bridge couplers realised as decoupling bridges which generate output-end, first high-frequency signals with respectively identical power should preferably be provided in order to supply associated input-end, second high-frequency signals via associated high-frequency lines.

In the case of high-frequency signal combiners with cascaded second bridge couplers realised as decoupling bridges, which combine more than four high-frequency signals, the input-end, second high-frequency signals, and therefore, in parallel bridge branches—that is, in diametrically opposing bridge branches—within the individual second bridge couplers and in diagonally opposed second bridge couplers of one cascade stage, preferably each provide at least approximately identical powers.

The first bridge couplers realised as decoupling bridges, of which the function is to generate from two input-end, first high-frequency signals, in some cases with different powers, that is, with different signal level and/or different signal phase, output-end, first high-frequency signals, in each case with an at least almost identical power, preferably provide, in each case, in diagonally opposing bridge branches, connections for supplying the input-end, first high-frequency signals and connections for the output of the output-end, first high-frequency signals in the respectively remaining bridge branches.

Power balancing resistors, each with an impedance corresponding to the system impedance of the high-frequency signal combiners, can be provided in the bridge diagonals of the first bridge couplers.

In a first preferred embodiment of the high-frequency signal combiner, two first bridge couplers are provided, in which a single connection for the supply of an output-end, first high-frequency signal is connected, in each case in diagonally opposing bridge branches of the decoupling bridges.

In a second preferred embodiment of the high-frequency signal combiner, a first bridge coupler is provided, in which two connections for the output of two output-end, first high-frequency signals are connected in the diagonally opposing bridge branches of the decoupling bridge disposed opposite.

In a first sub-variant of the second embodiment, the two output connections are connected in parallel in a bridge branch of the first bridge coupler. For reasons of symmetry, the wave impedance of the high-frequency lines connected to the two output connections here is, in each case, double the system impedance of the high-frequency signal combiner.

In a second sub-variant of the second embodiment, the two output connections are connected in series in a bridge branch of the first bridge coupler. For reasons of symmetry, the wave impedance of the high-frequency lines connected to the two connections here is, in each case, half the system impedance of the high-frequency signal combiner.

The high-frequency lines to the individual connections of the first and second bridge couplers are preferably embodied as coaxial lines, but can also be realised as strip lines.

Subject to the principle, each first and second bridge coupler provides only a single bridging node at ground potential. Accordingly, the outer conductors of the two high-frequency lines realised as coaxial lines which are not connected to the bridge branch of the first bridge coupler/s, which is disposed at ground potential, provide a potential different from the ground potential. Since the outer conductor of the coaxial line connected to the connection for the supply of a high-frequency signal is typically disposed at ground potential at the connection for the supply of a high-frequency signal, a voltage drop occurs in the outer conductor of the coaxial line between the connection for the supply of a high-frequency signal and the connection in the bridge branch of the first bridge coupler/s, which is not disposed at ground potential, and accordingly, an undesirable sheath wave occurs in the outer conductor of the coaxial line. In a similar manner, the outer conductor of the coaxial line connected to the second bridge coupler provides a voltage difference between the first and second bridge coupler because of the ohmic losses of the coaxial line, so that an undesirable sheath wave occurs in the outer conductor of the coaxial line. In order to avoid these undesirable sheath waves on the outer conductor of the coaxial lines, the high-frequency lines preferably provide an annular core in order to achieve a sheath-wave decoupling.

Figure 1B:
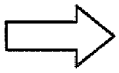
Figure 2A:
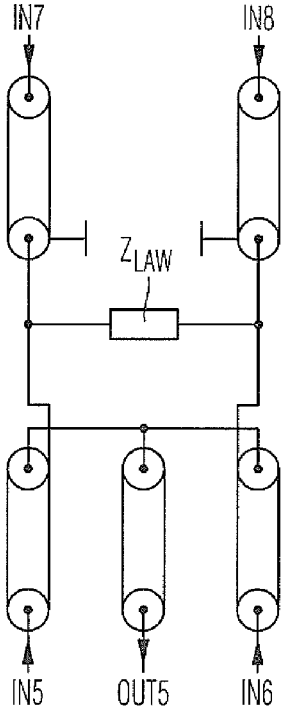
Figure 2B:
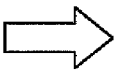
Figure 2B:
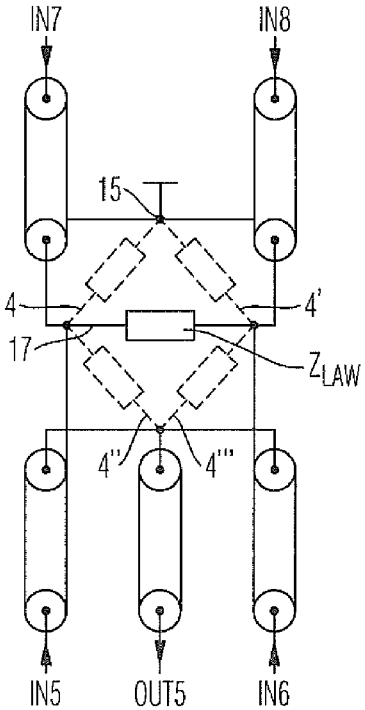
Figure 3:
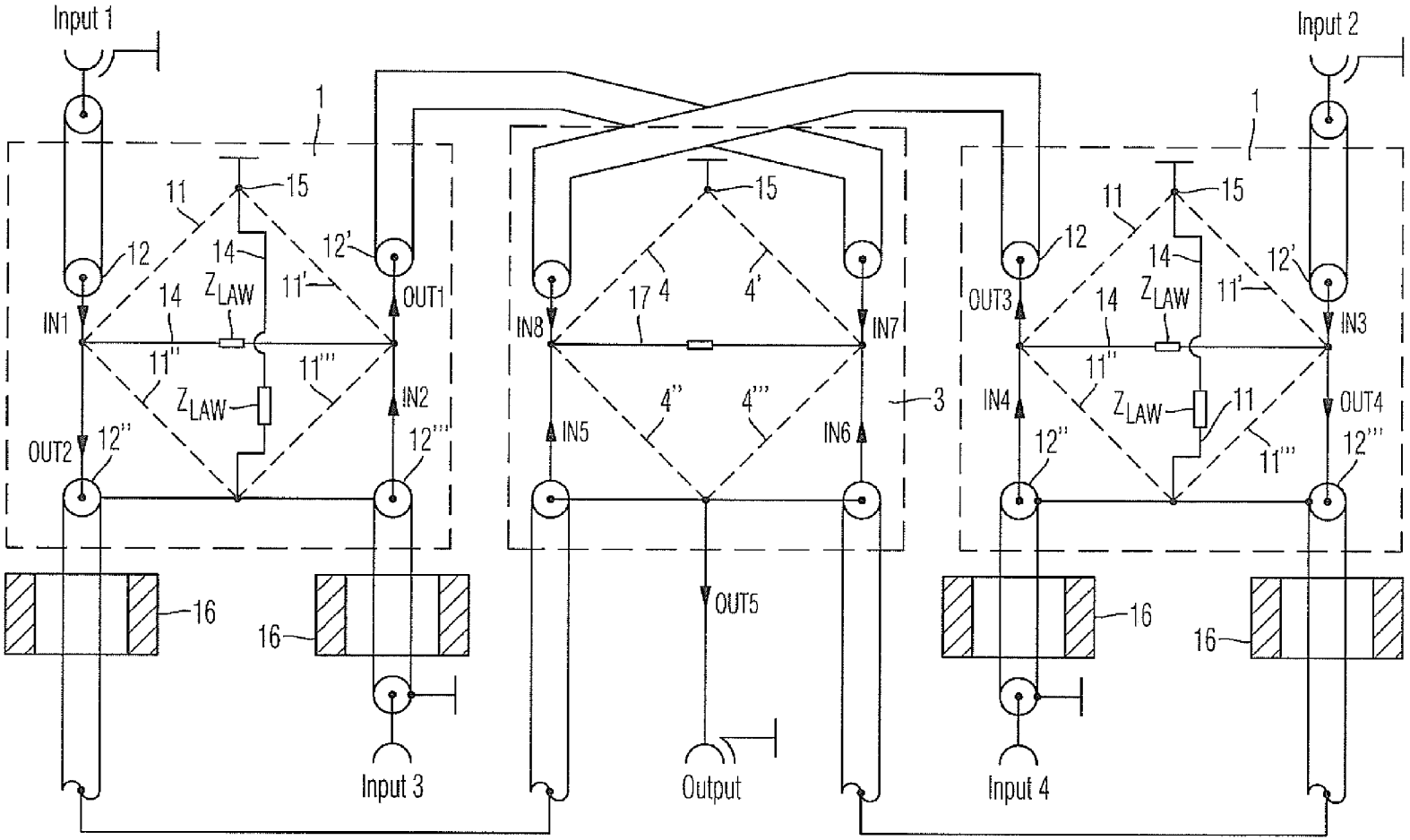
Figure 4B:
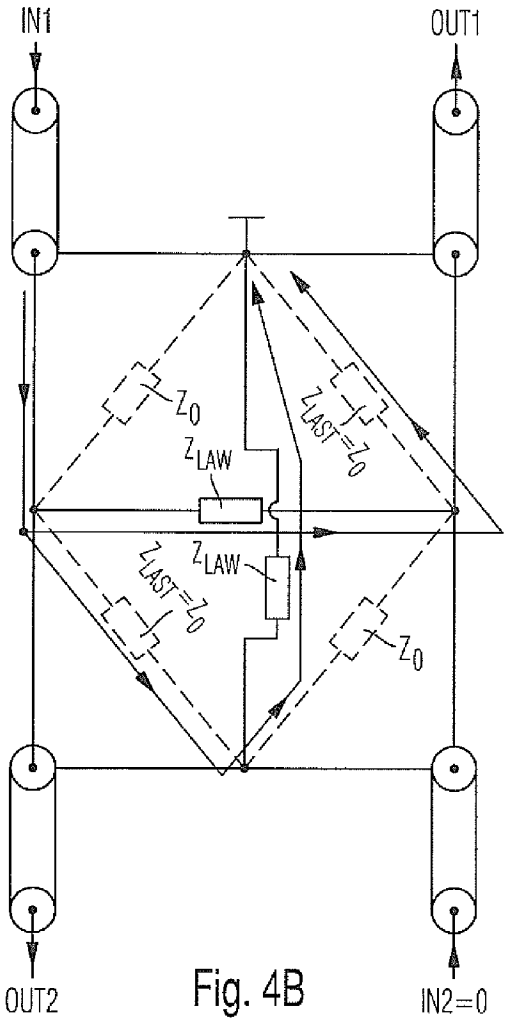
Figure 4A:
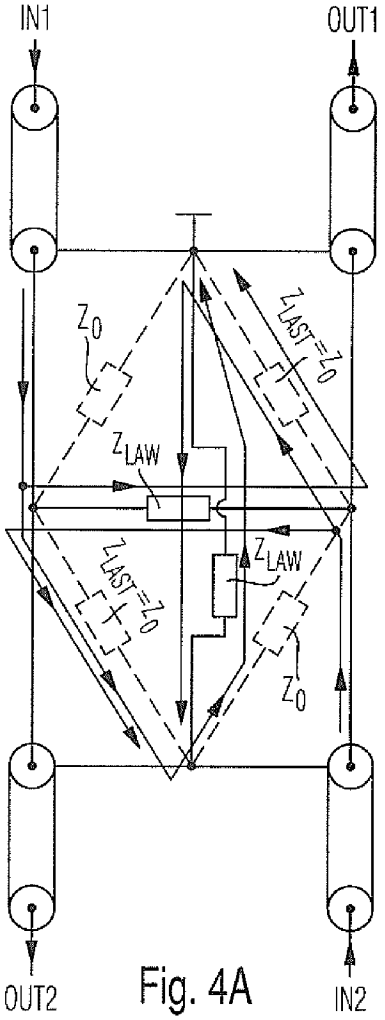
Figure 5B:
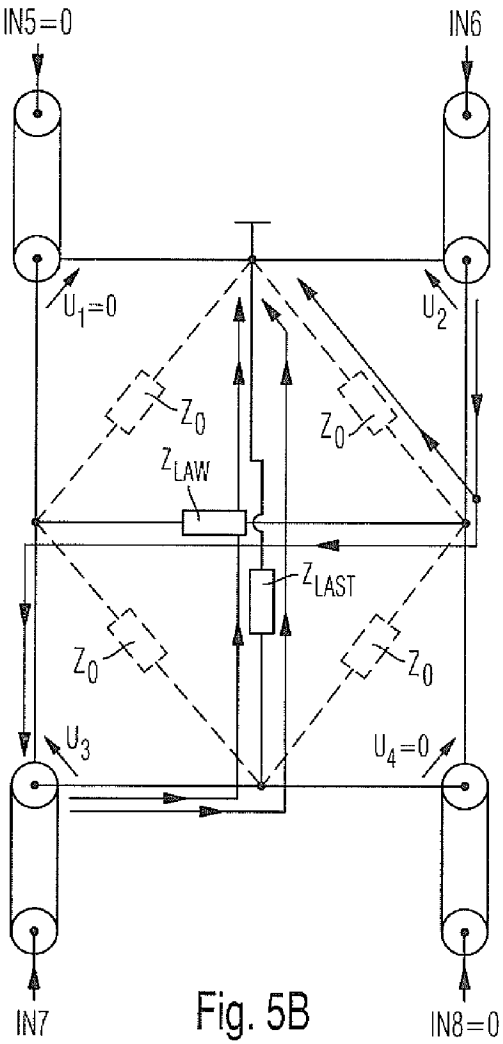
Figure 5A:
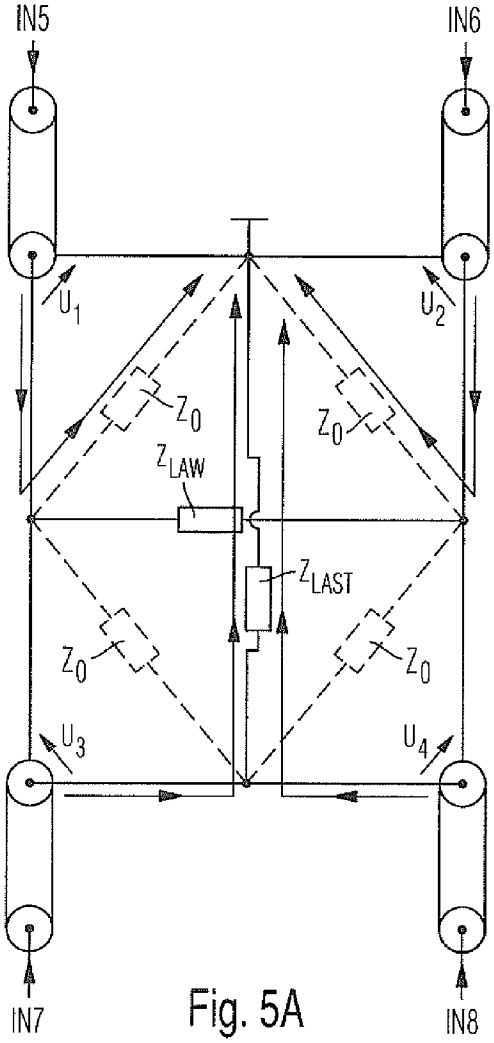
Figure 6:
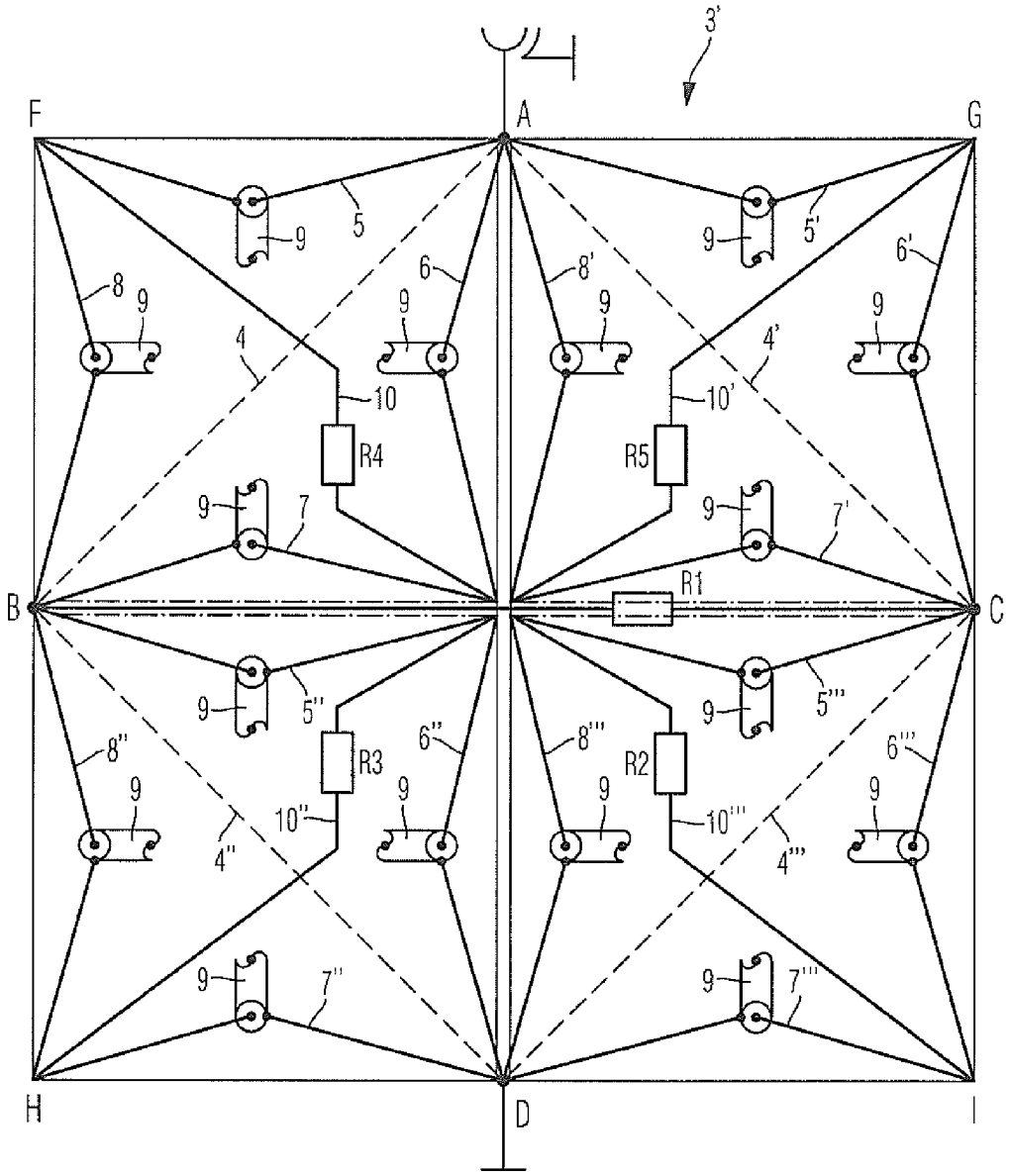
Figure 7B:
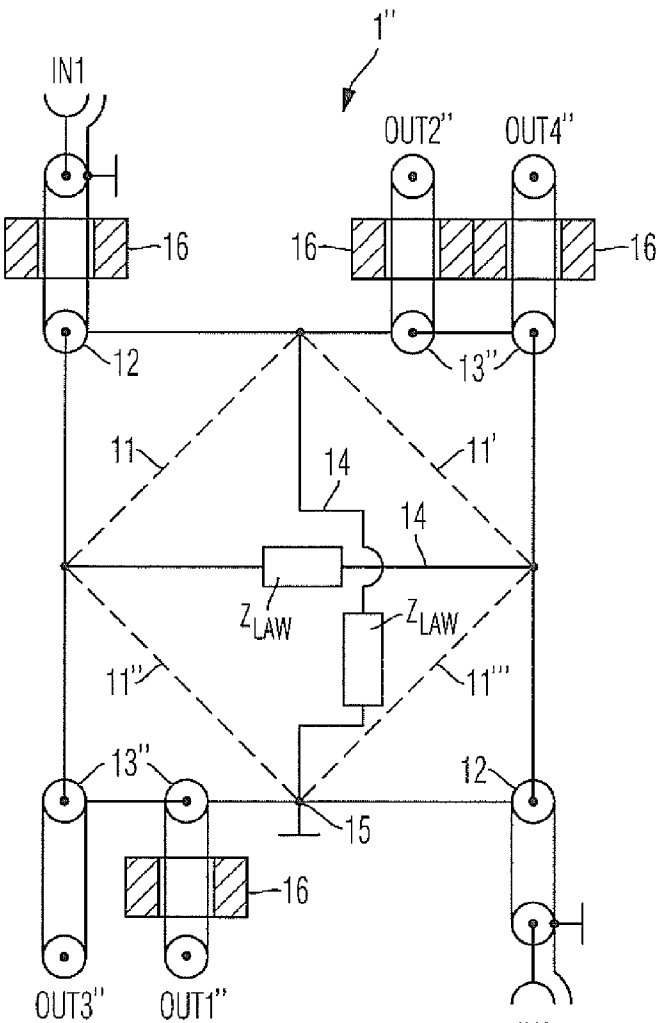
Figure 7A:
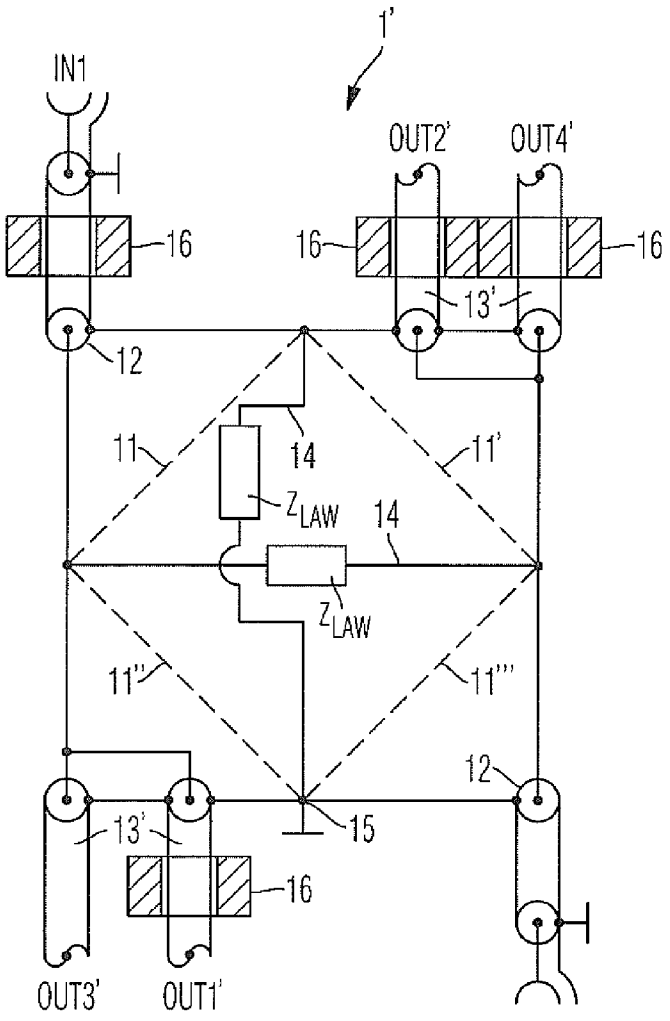
Figure 8A:
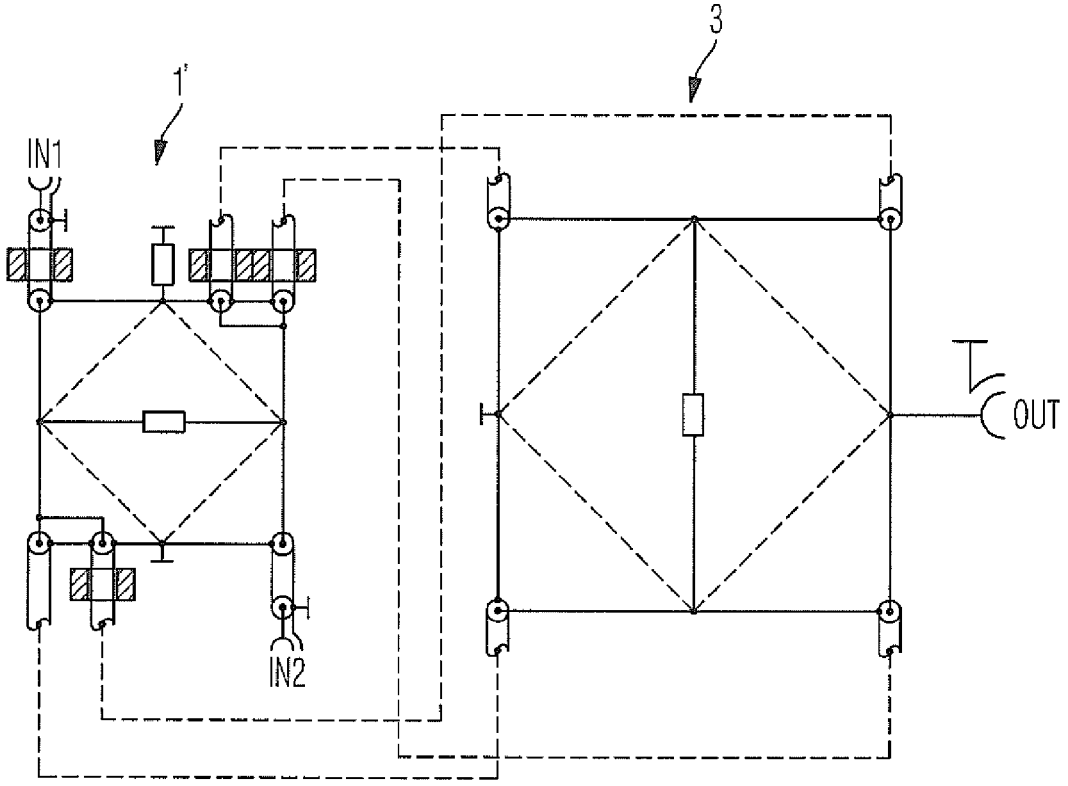
Figure 8B:
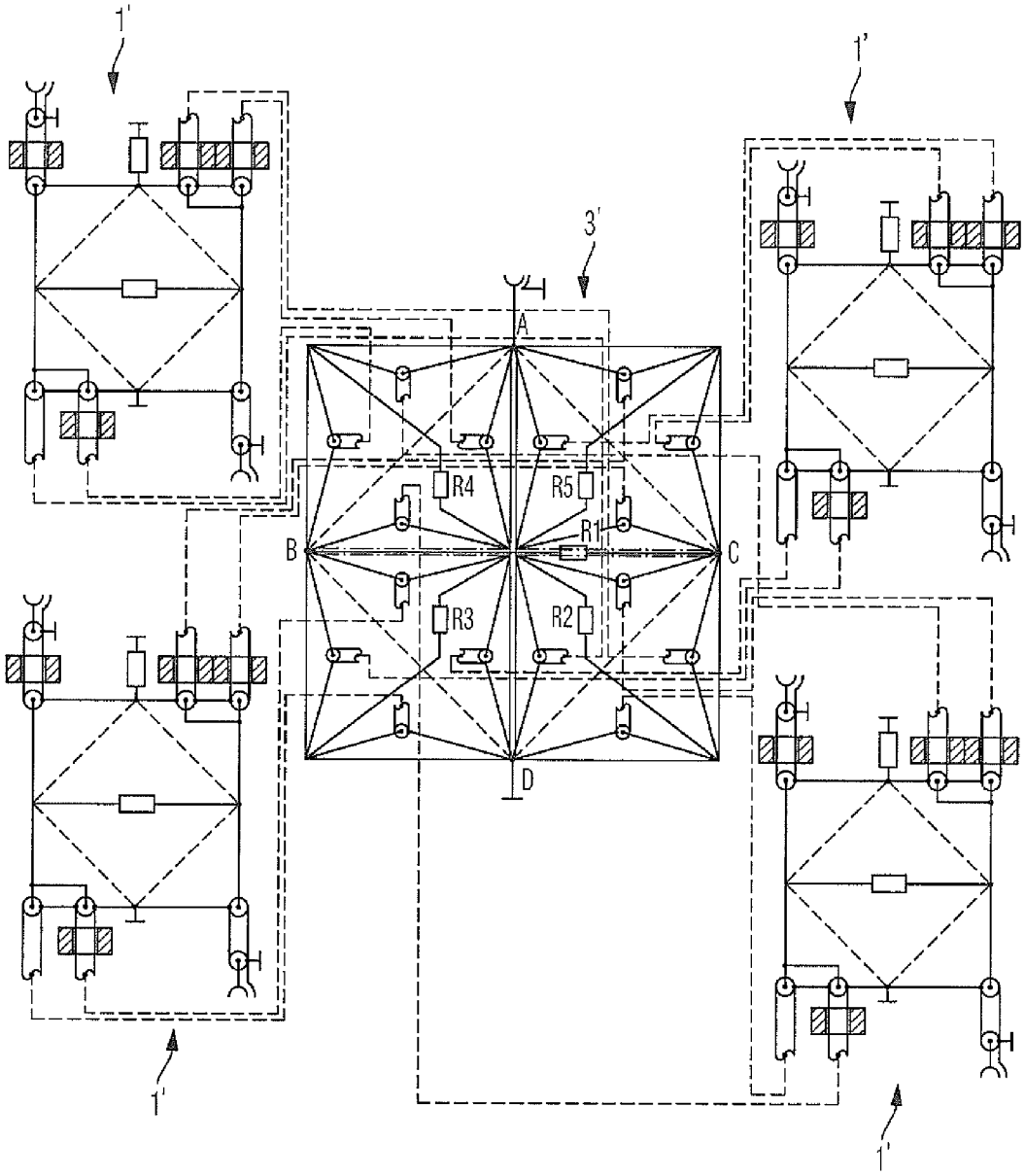
Figure 9:
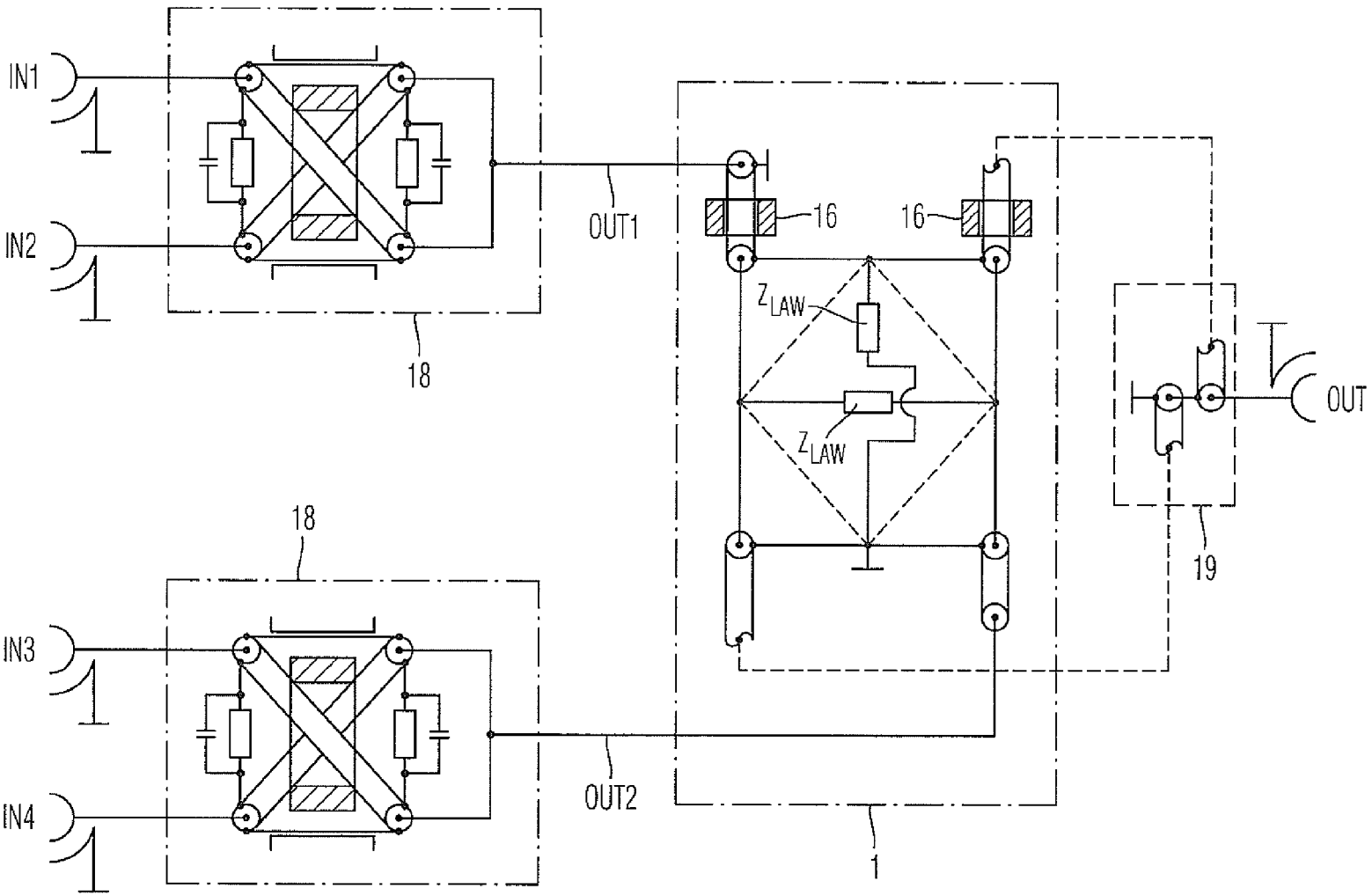

The high-frequency signal combiner according to the invention is explained in detail below with reference to preferred embodiments and sub-variants on the basis of the drawings. The drawings are as follows:

FIG. 1A a first circuit diagram for a decoupling bridge according to the prior art;

FIG. 1B a second circuit diagram for a formerly conventional decoupling bridge;

FIG. 2A a first circuit diagram for a formerly conventional coupling bridge;

FIG. 2B a second circuit diagram for a formerly conventional coupling bridge;

FIG. 3 a circuit diagram for a formerly conventional high-frequency signal combiner;

FIG. 4A a circuit diagram for a decoupling bridge supplied with two high-frequency signals;

FIG. 4B a circuit diagram for a decoupling bridge supplied with one high-frequency signal;

FIG. 5A a circuit diagram for a coupling bridge supplied with four high-frequency signals;

FIG. 5B a circuit diagram for a coupling bridge supplied with two high-frequency signals;

FIG. 6 a circuit diagram for an exemplary embodiment of a coupling bridge according to the invention;

FIG. 7A a circuit diagram for a first exemplary embodiment of a decoupling bridge according to the invention;

FIG. 7B a circuit diagram for a second embodiment of a decoupling bridge according to the invention;

FIG. 8A a circuit diagram for an exemplary embodiment of a high-frequency signal combiner with decoupling bridge according to the invention;

FIG. 8B a circuit diagram for an exemplary embodiment of a high-frequency signal combiner according to the invention; and FIG. 9 a circuit diagram for a simplified exemplary embodiment of a high-frequency signal combiner according to the invention.

Figure 1B:
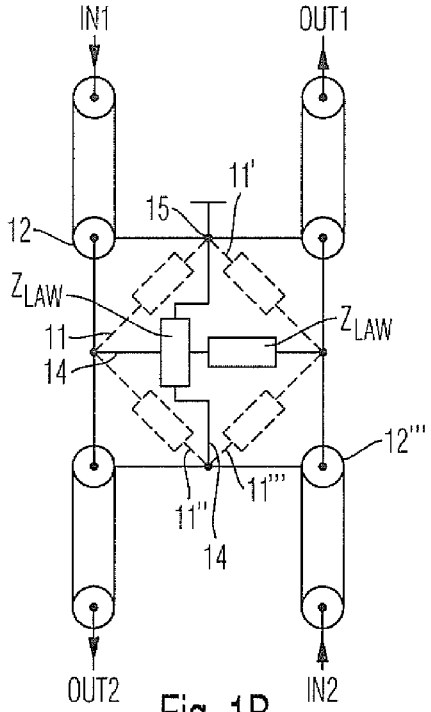

Before the method of functioning of the high-frequency signal combiner according to the invention is explained in detail, the following section describes the method of functioning of the high-frequency signal combiner according to the prior art, as specified, for example, in FIG. 1 from U.S. Pat. No. 6,407,648 B1, which is necessary for an understanding of the method of functioning of the high-frequency signal combiner according to the invention.

The high-frequency signal combiner according to the prior art, as shown in FIG. 3, which combines a total of four input-end, first high-frequency signals IN1, IN2, IN3 and IN4 to form one output-end, second high-frequency signal OUT5, comprises two decoupling bridges 1, in which, respectively two of the total of four input-end, first high-frequency signals IN1, IN2, 1N3, IN4 are transformed by means of splitting and combination, respectively into two output-end, first high-frequency signals OUT1, OUT2, OUT3, OUT4 of identical power in each case, and a downstream coupling bridge 3, in which the four output-end, first high-frequency signals OUT1, OUT2, OUT3, OUT4 with the respectively identical power at the output 12', 12" of the two decoupling bridges 1 are transformed in a lossless manner to form a single output-end, second high-frequency signal OUT5.

A decoupling bridge of this high-frequency signal combiner with the two input-end, first high-frequency signals IN1 and IN2 and the two output-end, first high-frequency signals OUT1 and OUT2, which corresponds to the decoupling bridge comprising the resistors 82 and 86 or respectively 84 and 88 in FIG. 1 of U.S. Pat. No. 6,407,648 B1, is illustrated in FIG. 1A. The illustration of a decoupling bridge in FIG. 1A can be converted into an equivalent illustration of a decoupling bridge in FIG. 1B.

The illustration of a decoupling bridge according to FIG. 1B shows the associated bridge branches 11, 11', 11", 11'" illustrated with dotted lines and the associated bridge diagonals 14 illustrated with a continuous line. The bridge branches connected directly to the connections 12, 12'" of the input-end, first high-frequency lines represent the coupling branches. The impedance provided respectively in the associated bridge branches and also illustrated with dotted lines corresponds to the input impedance and accordingly to the wave impedance $Z_0$ of the associated input-end, first high-frequency line. The bridge branches connected to the output-end high-frequency lines represent the decoupling branches. The impedance provided respectively in the associated bridge branches and also illustrated with dotted lines corresponds to the input impedance and accordingly to the wave impedance $Z_0$ of the output-end high-frequency line, which, with ideal matching corresponds to the load impedance $Z_{Last}$.

Load balancing resistors $Z_{LAW}$ are provided in each of the two bridge diagonals 14. The bridge nodes of the decoupling bridge are each connected to the inner conductors or the outer conductors of two high-frequency lines conducting an input-end and an output-end high-frequency signal IN1, IN2, OUT1, OUT2 in each case. As determined by the method of functioning, only a single bridge node 15—a bridge node connected to outer conductors of high-frequency lines—is connected to ground potential.

The method of functioning of a decoupling bridge is shown by the two operational cases illustrated respectively in FIG. 4A and FIG. 4B.

In the operational case illustrated in FIG. 4A, both input-end, first high-frequency signals N1 and IN2 are fed into the decoupling bridge from the respective input circuits via the inner conductor of the input-end high-frequency lines. The two input-end, first high-frequency signals IN1 and IN2 are split in the decoupling bridge respectively into two partial currents, as illustrated in FIG. 4A with the directional current-flow lines.

The one partial current of the two input-end high-frequency signals IN1 and IN2 flows respectively via the inner conductor of the output-end high-frequency line, the load impedance $Z_{LAST}$, the outer conductor of the output-end high-frequency line, the load balancing resistor $Z_{LAW}$, illustrated vertically in FIG. 4A, and the outer conductor of the input-end high-frequency line, back into the respective input circuits. The current flow of this partial current via the inner conductor of the output-end high-frequency line, the load impedance $Z_{LAST}$ and the outer conductor of the output-end high-frequency line is illustrated in a simplified manner in FIG. 4A via the impedance present in the associated bridge branch, which corresponds to the wave impedance $Z_0$ of the output-end high-frequency line.

The other partial current of the two input-end, first high-frequency signals IN1 and IN2 flows via the load balancing resistor $Z_{LAW}$ illustrated horizontally in FIG. 4A, the outer conductor of the respectively other output-end high-frequency line, the load impedance $Z_{LAST}$, the outer conductor of the respectively other output-end high-frequency line to ground. The current flow of this partial current via the inner conductor of the output-end high-frequency line, the load impedance $Z_{LAST}$ and the outer conductor of the output-end high-frequency line is once again illustrated in a simplified manner in FIG. 4A via the impedance present in the associated bridge branch, which corresponds to the wave impedance $Z_0$ of the output-end high-frequency line.

If the powers of the two input-end high-frequency signals IN1 and IN2 are each identical, the two associated partial currents through the vertical and horizontal load balancing resistor $Z_{LAST}$ are also identical. Since the partial currents in the vertical and horizontal load balancing resistor $Z_{LAST}$ associated with the two input-end high-frequency signals IN1 and IN2 are each guided in opposite directions, over all, no current flows through the vertical and horizontal load balancing resistor $Z_{LAST}$, and accordingly, no loss occurs in the two load balancing resistors $Z_{LAW}$. Since the two load resistors $Z_{LAST}$ and the two load balancing resistors $Z_{LAW}$ are identical and correspond to the system wave impedance $Z_0$ of the decoupling bridge, the two load resistors $Z_{LAST}$ receive from the two input-end high-frequency signals IN1 and IN2, in each case, a partial current of the same level, which corresponds respectively to half the current of the two input-end high-frequency signals IN1 and IN2. Accordingly, an identical power, which corresponds to the sum of the currents of the two input-end high-frequency signals IN1 and IN2, is supplied to the two load impedances $Z_{LAST}$.

If the powers of the two input-end high-frequency signals IN1 and IN2 differ from one another, the two partial currents in the vertical and horizontal load balancing resistor $Z_{LAST}$ do not compensate one another, and, over all, a current flows through the vertical and horizontal load balancing resistor $Z_{LAST}$, of which the current direction is determined by the input-end high-frequency signal IN1 or respectively IN2 with the relatively higher power. Because of the current flow through the vertical and horizontal load balancing resistor $Z_{LAST}$, the two load impedances $Z_{LAST}$ do in fact receive an identical power, which is, however, reduced by comparison with a case with a supply of identical powers by the two input-end high-frequency signals IN1 and IN2, because of the loss in the two load balancing resistors $Z_{LAW}$.

In the operational case illustrated in FIG. 4B, only a single input-end, first high-frequency signal, namely, the input-end, first high-frequency signal IN1, is fed into the decoupling bridge from its input circuit via the inner conductor of the associated input-end high-frequency line. The two load impedances $Z_{LAST}$, each receive only a partial current, which corresponds to half the current of the active input-end, first high-frequency signal IN1. The two load impedances and the two load balancing resistors each receive a quarter of the power supplied from the input-end, first high-frequency signal IN1.

A coupling bridge of the high-frequency signal combiner according to the prior art with the input-end high-frequency signals IN5, IN6, IN7, IN8 and the output-end high-frequency signal OUT5, which corresponds to the coupling bridge comprising the resistor 90 in FIG. 1 of U.S. Pat. No. 6,407,648 B1, is illustrated in FIG. 2A. The illustration of a coupling bridge in FIG. 2A can be converted into an equivalent illustration of a coupling bridge in FIG. 2B. The illustration of a coupling bridge according to FIG. 2B shows the associated bridge branches 4, 4', 4", 4'" illustrated with dotted lines and the associated bridge diagonals 17 illustrated with a continuous line. The bridge branches connected to the input-end high-frequency lines represent the coupling branches. The impedances provided respectively in the associated bridge branches and also illustrated with dotted lines correspond, in the case of an input-end matching, to the input impedance and therefore to the wave impedance $Z_0$ of the input-end high-frequency line. The decoupling branch, which is not illustrated in FIG. 2B, is disposed in the bridge diagonal between the bridge node connected to the inner conductor of the output-end high-frequency line OUT5 and the bridge node 15 disposed at ground potential.

A load balancing resistor $Z_{LAW}$ is provided in the bridge diagonal disposed between the inner conductors of the four input-end high-frequency lines, illustrated vertically in FIG. 2B. In the horizontal bridge diagonal, which is not illustrated in FIG. 2B but which forms the decoupling branch, the load impedance $Z_{LAST}$, which, in the case of an optimum output-end matching, corresponds to the wave impedance $Z_0$ of the output-end high-frequency line and therefore corresponds to the system wave impedance of the coupling bridge $Z_0$, is disposed between the bridge node 15 connected to the inner conductor of the output-end high-frequency line OUT5 and the bridge node disposed at ground potential.

The bridge nodes of the coupling bridge are each connected to the inner conductors or the outer conductors of the four high-frequency lines each carrying input-end, second high-frequency signals IN5, IN6, IN7, IN8. Determined by the method of functioning, only a single bridge node 15—a bridge node connected to the outer conductors of the high-frequency lines—is connected to ground potential.

The method of functioning of a decoupling bridge is shown with reference to the two operational cases illustrated respectively in FIG. 5A and FIG. 5B:

In the operational case illustrated in FIG. 5A, all four input-end, second high-frequency signals IN5, IN6, IN7, IN8 are fed into the coupling bridge via the inner conductor of the input-end high-frequency lines. While the two input-end, second high-frequency signals IN5 and IN6 are fed into the bridge diagonal with the load impedance $Z_{LAST}$ because of the direct connection, the two input-end, second high-frequency signals IN7 and IN8 are fed into the respective outer conductor of the high-frequency lines associated with the input-end, second high-frequency signals IN5 and IN6. The input-end, first high-frequency signals IN7 and IN8 fed into the outer conductor of the high-frequency lines associated with the input-end, second high-frequency signals IN5 and IN6 are fed back into the coupling bridge via the inner conductor of the high-frequency lines associated with the input-end, second high-frequency signals IN5 and IN6 and guided via the load impedance $Z_{LAST}$ to the bridge node 15 at ground potential. As illustrated in FIG. 5A, this current flow can be displayed by a current flow via an impedance with the wave impedance $Z_0$ of the high-frequency line associated with the input-end, second high-frequency signal IN5 and/or IN6 in the bridge branch between the bridge node which is connected to the inner conductor of the high-frequency line associated with the respective input-end, second high-frequency signal IN7 and IN8, and the bridge node at ground potential.

To achieve an optimal decoupling of the four input powers, the input powers must be identical especially in respectively opposite bridge branches (ideally, they are identical in all four inputs). In this case, as a prerequisite for an optimal decoupling of the four input powers, the sum of the two voltages $U_1$ and $U_3$ is identical to the sum of the two voltages $U_2$ and $U_4$.

If one pair of input powers decreases by comparison with the other pair of input powers, the potentials in the bridge nodes which are connected to the power balancing resistor $Z_{LAW}$ and, in the case of identical input powers of all four inputs, correspond to half the output voltage, are displaced.

In the operational case illustrated in FIG. 5B, no powers are fed into the mutually opposing high-frequency lines associated with the input-end, second high-frequency signals IN5 and IN8. The input-end, second high-frequency signal IN7 flows directly via the load impedance $Z_{LAST}$ to ground. Because of a voltage drop, the input-end, second high-frequency signal IN6 is conducted via the load balancing resistor $Z_{LAW}$, illustrated horizontally in FIG. 5B-equivalent to the voltage $U_2$ at the connection of the high-frequency line conducting the input-end, second high-frequency signal IN6—and guided to ground via the outer conductor of the high-frequency line guiding the input-end, second high-frequency signal IN7, the upstream decoupling circuit, the inner conductor of the high-frequency line guiding the input-end, second high-frequency signal IN7 and the load impedance $Z_{LAST}$.

If two input-end, first high-frequency signals IN1 and IN2 or respectively IN3 and IN4 are guided respectively to a first bridge coupler 1, which is realised as a decoupling bridge according to FIG. 1A or respectively 1B, and if the associated output-end, first high-frequency signals OUT1 and OUT2 or respectively OUT3 and OUT4 are supplied via high-frequency lines as input-end, second high-frequency signals to the four input connections of a second bridge coupler 3, which is realised as a coupling bridge according to FIG. 2A, an output-end, second high-frequency signal OUT5, which comprises the combination of the input-end, first high-frequency signals IN1, IN2, IN3 and IN4 supplied to the individual decoupling bridges, can be picked up at the output connection of the coupling bridge 9.

In this manner, the high-frequency signal combiner illustrated in FIG. 3 is obtained. If the input powers of the four input-end, first high-frequency signals IN1, IN2, IN3 and IN4 are each identical, no power losses occur at the load balancing resistors of the decoupling bridges 1, and the power of the output-end, second high-frequency signal OUT5 disposed at the output connection of the coupling bridge 3 corresponds to the sum of the input powers of the input-end, first high-frequency signals IN1, IN2, IN3 and IN4 disposed at the input connections of the decoupling bridge.

Those high-frequency lines which are connected by the one connection to bridge branches of decoupling bridges without connection to a ground, and by the other connection to a connection with ground potential or an arbitrary other potential, provide a voltage potential in the outer conductor between their two connections, which causes an undesirable sheath wave on the outer conductor. In order to attenuate these sheath waves, the respective high-frequency line is surrounded by an annular core 16 in the region of its connection which is connected to a bridge branch of a decoupling bridge without ground connection.

FIG. 7A illustrates a first exemplary embodiment of a decoupling bridge 1', in which, respectively, two connections 13' wired in parallel are provided in the diagonally opposing bridge branches 11' and 11" for each output-end high-frequency line. In order to realise a symmetrical decoupling bridge, the output-end high-frequency lines each provide double the wave impedance by comparison with the wave impedance of the input-end high-frequency line.

FIG. 7B illustrates a second embodiment of a decoupling bridge 1", in which, respectively two connections 13" wired in series are provided for each output-end high-frequency line in the diagonally opposing bridge branches 11' and 11'". In order to realise a symmetrical decoupling bridge, the output-end high-frequency lines each provide half the wave impedance by comparison with the wave impedance of the input-end high-frequency line.

Accordingly, with these two embodiments of a decoupling bridge, two input-end, first high-frequency signals IN1, IN2 can be split into four output-end, first high-frequency signals OUT1', OUT2', OUT3', OUT4' or respectively OUT1", OUT2", OUT3", OUT4", in each case with identical power. FIG. 8A shows a high-frequency signal combiner in which the four inputs of a coupling bridge are connected to the four outputs of a second embodiment of a single decoupling bridge.

FIG. 6 shows a coupling bridge 3' according to the invention, which is derived from an original coupling bridge and provides a total of 16 connections, 9 for output-end, second high-frequency signals:

For this purpose, each bridge branch 4, 4', 4", 4'" of the original coupling bridge provides a bridge diagonal of an sub-coupling bridge. A load balancing resistor R2, R3, R4, R5 is provided in the bridge diagonals 10, 10', 10", 10'" orthogonal to this bridge diagonal of every sub-coupling bridge. In each case, two bridge nodes of each sub-coupling bridge are connected to a bridge node A, B, C, D of the original coupling bridge. One bridge node E of every sub-coupling bridge is combined in a "star shape" to form a common point.

Finally, in each case, a bridge node F, G, H, I of each sub-coupling bridge forms the four diagonal corner points of the high-frequency signal combiner according to the invention. A connection 9 for an input-end high-frequency signal is provided in each case in the individual bridge branches of the four sub-coupling bridges.

In order to achieve a feedback freedom of the individual inputs of the high-frequency signal combiner according to the invention, the powers in opposite, that is to say, parallel, bridge branches of a sub-coupling bridge, and in opposite, that is to say, parallel, bridge branches of sub-coupling bridges disposed respectively diagonally opposite, must each be identical. In this case, the voltage drop in the individual bridge diagonals of the original high-frequency signal combiner, which is generated from the voltages in the two bridge triangles adjacent to the respective bridge diagonal, is always the same.

A correct functioning of the coupling bridge according to the invention is achieved with identical impedances in the bridge branches and bridge diagonals (load impedance $Z_{LAST}$ and load balancing resistor $Z_{LAW}$), which correspond to the wave impedance $Z_0$ of the connected high-frequency lines.

Subject to this principle, the coupling bridge according to the invention can be cascaded in any required manner, whereas a number of inputs for input-end high-frequency signals increased by a factor of four is achieved in each cascade stage.

FIG. 8B shows a first embodiment of a high-frequency signal combiner according to the invention, which provides a coupling bridge 3' according to the invention, of which 16 high-frequency inputs are each supplied with input-end, second high-frequency signals, which are generated from four decoupling bridges 1 with respectively four outputs 13', whereas the four outputs 13' of the individual decoupling bridges 1 are formed respectively by two outputs 13' wired in parallel in two bridge branches 11', 11'" of the decoupling bridge 3' (first embodiment of a decoupling bridge). As an alternative, decoupling bridges 3" of the second embodiment can also be used.

FIG. 9 shows a simplified high-frequency signal combiner. In this case, two input-end high-frequency signals IN1 and IN2 or respectively IN3 and IN4 are combined respectively in two identical signal combiners 18 to form one output-end high-frequency signal OUT1 and respectively OUT 2. These output-end high-frequency signals OUT1 and OUT2 are supplied to the two inputs of a decoupling bridge 1 according to FIG. 1A or respectively 1B.

The two output-end high-frequency signals of the decoupling bridge 1 are supplied to the two inputs of a coupling bridge 18. Instead of four inputs, as in the case of a coupling bridge 3 according to FIG. 2A or respectively 2B, this coupling bridge 18 provides only two inputs. However, it is derived from the coupling bridge 3 according to FIG. 2A or 2B, in that the inner conductor or respectively the outer conductor of the high-frequency line conducting the input-end, second high-frequency signal IN5 in FIG. 2A or 2B, with the inner conductor or respectively the outer conductor of the high-frequency line conducting the input-end, second high-frequency signal IN6 are combined to form the inner conductor or respectively outer conductor of a common high-frequency line, and the inner conductor or respectively the outer conductor of the high-frequency line conducting the input-end, second high-frequency signal IN7 with the inner conductor and respectively outer conductor of the high-frequency line conducting the input-end, second high-frequency signal IN8 are combined to form the inner conductor or respectively outer conductor of a common high-frequency line. In this manner, the bridge branches and the bridge diagonals with the load balancing resistor $Z_{LAW}$ of the original coupling bridge 3 disappear.

Furthermore, by combining two input connections originally wired in parallel in the coupling bridge 19, the decoupling bridge 1, as illustrated in FIG. 9, does not contain two associated output connections wired in parallel, but only one output connection, which, by comparison with the input connection of the decoupling bridge 1, provides double the input impedance because of the combination of two parallel high-frequency lines and therefore of two parallel output connections. The two common high-frequency lines between the decoupling bridge and the coupling bridge, which are derived from the combination of two individual high-frequency lines, also provide double the wave impedance by comparison with the wave impedance of the individual high-frequency lines.

The invention is not restricted to the illustrated embodiments of the high-frequency signal combiner according to the invention, the decoupling bridge according to the invention and the coupling bridge according to the invention. Other configurations of output connections in the bridge branches of the decoupling bridges according to the invention, for example, output connections arranged in decoupling bridges, are also covered by the invention. Moreover, the use of any kind of high-frequency lines,—coaxial lines, strip lines and so on—is also covered by the invention.

The invention claimed is:

1. A high-frequency signal combiner comprising:

at least one first bridge coupler for transforming two first high-frequency input signals into at least two first high-frequency output signals, wherein each of the at least two first high-frequency output signals has approximately identical power; and a cascade of second bridge couplers that add a number of first high-frequency output signals equal to four raised to an integer power, wherein the integer power is a number of cascade stages, and wherein four second bridge couplers of a cascade stage form respective bridge branches of a second bridge coupler of a subsequent cascade stage, wherein each of the four second bridge couplers have four connections that receive respective first high-frequency output signals.

2. The high-frequency signal combiner according to claim 1, wherein the second bridge couplers are used for the transformation of at least four second high-frequency input signals, each of which at least has approximately identical power, into one second high-frequency output signal, the power of which corresponds to a summated power of the four second high-frequency input signals, and wherein the four second high-frequency input signals of a second bridge coupler are each supplied from one first high-frequency output signal.

3. The high-frequency signal combiner according to claim 1, wherein every bridge branch of a second bridge coupler of the cascade stage forms a bridge diagonal of a second bridge coupler of the subsequent cascade stage, and wherein every bridge branch of the subsequent cascade stage is formed respectively by a connection of a high-frequency line.

4. The high-frequency signal combiner according to claim 3, wherein a load balancing resistor with an impedance identical to a system impedance of the high-frequency signal combiner is connected in another bridge diagonal transversely to a direction of signal energy of the second bridge coupler of the subsequent cascade stage.

5. The high-frequency signal combiner according to claim 2, wherein the powers of second high-frequency input signals in parallel bridge branches within a second bridge coupler and in second bridge couplers of a cascade stage disposed respectively diagonally opposite are identical.

6. The high-frequency signal combiner according to claim 1, wherein the high-frequency signal combiner comprises two first bridge couplers, each with two first high-frequency output signals.

7. The high-frequency signal combiner according to claim 1, wherein the at least one first bridge coupler includes a first bridge coupler for transforming the two first high-frequency input signals into four first high-frequency output signals.

8. The high-frequency signal combiner according to claim 7, wherein, in order to output four first high-frequency output signals, two parallel connections are provided respectively in diametrically opposing bridge branches, to which high-frequency lines, each with a wave impedance doubled relative to a system impedance of the high-frequency signal combiner, are connected.

9. The high-frequency signal combiner according to claim 7, wherein, in order to output four first high-frequency output signals, two serial connections are provided respectively in diametrically opposing bridge branches, to which high-frequency lines, each with a wave impedance halved relative to a system impedance of the high-frequency signal combiner, are connected.

10. The high-frequency signal combiner according to claim 1, wherein, in order to supply two first high-frequency input signals, connections are provided respectively in diametrically opposing bridge branches of the at least one first bridge coupler, and, in order to output at least two first high-frequency output signals, connections are provided respectively in the two remaining bridge branches of the at least one first bridge coupler.

11. The high-frequency signal combiner according to claim 1, wherein a load balancing resistor with an impedance identical to a system impedance of the high-frequency signal combiner is connected respectively in both bridge diagonals of the first bridge coupler.

12. The high-frequency signal combiner according to claim 2, wherein every first bridge coupler and every second bridge coupler provides respectively a single bridge node connected to ground.

13. The high-frequency signal combiner according to claim 1, wherein every high-frequency line connected to a first bridge coupler and/or a second bridge coupler provides respectively one annular core for decoupling a sheath wave.

* * * * *